United States Patent [19]

Mon

[11] 3,986,527

[45] Oct. 19, 1976

[54] LAMINAR FLOW DIGITAL LOGIC ELEMENTS WITH FEEDBACK

[75] Inventor: George Mon, Silver Spring, Md.

[73] Assignee: The United States of America as represented by the Secretary of the Army, Washington, D.C.

[22] Filed: Nov. 6, 1975

[21] Appl. No.: 629,453

[52] U.S. Cl. ..... 137/819; 137/835; 137/837

[51] Int. Cl.[2] ..... F15C 1/12

[58] Field of Search ..... 137/807, 818, 819, 820, 137/821, 835, 837, 841

[56] References Cited

UNITED STATES PATENTS

| | | | |
|---|---|---|---|
| 3,371,675 | 3/1968 | Hatch, Jr. | 137/835 |
| 3,515,159 | 6/1970 | Bermel | 137/819 |
| 3,557,814 | 1/1971 | Neradka | 137/835 X |
| 3,587,602 | 6/1971 | Urbanosky | 137/818 X |
| 3,667,489 | 6/1972 | Blaiklock | 137/837 |
| 3,926,221 | 12/1975 | Woods | 137/819 |

*Primary Examiner*—William R. Cline

*Attorney, Agent, or Firm*—Nathan Edelberg; Robert P. Gibson; Saul Elbaum

[57] ABSTRACT

Improved fluid logic elements are disclosed employing a laminar proportional fluid amplifier connected in a feedback arrangement. Logic functions such as AND, OR, and NOR as well as the flip-flop can be implemented with a reduced power consumption and signal to noise ratio relative to turbulent wall-attachment devices. In one embodiment, the outputs of a first laminar proportional fluid amplifier are input to a second laminar proportional fluid amplifier so as to decouple the operation of the first amplifier from a utilization circuit.

14 Claims, 8 Drawing Figures

PRIOR ART
FLUIDIC "AND" GATE

LAMINAR PROPORTIONAL
AMPLIFIER WITH CONTROL
INPUT BELOW SATURATION

LAMINAR PROPORTIONAL
AMPLIFIER WITH CONTROL
INPUT ABOVE SATURATION

AND/OR

FLIP – FLOP

FEEDBACK OSCILLATOR/
FREQUENCY MODULATOR

LAMINAR FLOW DIGITAL LOGIC ELEMENTS WITH FEEDBACK

RIGHTS OF THE GOVERNMENT

The invention described herein may be manufactured, used and licensed by or for the United States Government for governmental purposes without the payment to me of any royalty thereon.

FIELD OF THE INVENTION

The invention disclosed herein relates to digital logic apparatus and more particularly relates to fluid logic elements.

BACKGROUND OF THE INVENTION

Fluidic control devices perform the operations of amplification and switching fluidically rather than electrically. For some purposes they are more reliable than their electronic counterparts. FIG. 1 shows a prior art fluidic AND gate. A high-energy stream of fluid, called the supply stream, is pumped in through the inlet port 4. The stream passes across a widened chamber 5 and arrives at a fork consisting of two outgoing channels 10 and 12 separated by a pointed structure called a splitter 13. In this system of FIG. 1, the chamber 5 is asymmetric, with the side-wall 8 being relatively close to the path of the fluid as it exits from the input port 4. The fluid supply stream, left to itself, attaches onto the wall 8 of the channel in which it is flowing, and as a result, the stream exits through the outlet 10 on that side. An injection of fluid from the control jet 6 on the same side-wall 8 will cause the stream to swing over to the other side and exit through the channel 12. The stream maintains a stable position exiting through channel 10 unless it is switched by the control jet 6. The stream is locked onto the wall 8 as long as the stream keeps flowing, because along the wall 8, a region of low pressure turbulence persists due to the phenomenon known as the Coanda effect. If the fluid entering the supply stream port 4 is considered to be a binary variable A and the air stream entering the control jet 6 is considered to be the binary variable B, fluid exiting from the channel 12 represents the binary logial AND function A.B. Since the Coanda effect depends upon the asymmetric, turbulent flow of the fluid through the device 2, it is inherently very noisy in nature, has a relatively high rate of power consumption, suffers from a limited dynamic range, and has a poor reproducability for its threshold level.

OBJECTS OF THE INVENTION

It is therefore an object of the invention to perform fluid logic functions with a higher signal to noise ratio.

It is still another object of the invention to perform fluid logic functions with a lower power consumption.

It is still a further object of the invention to perform fluid logic functions with a higher dynamic range.

It is still another object of the invention to perform fluid logic functions with a reproducable threshold level.

SUMMARY OF THE INVENTION

These and other objects, features and advantages of the invention are accomplished by the laminar flow digital logic elements with feedback, disclosed herein. The elements are based upon a laminar flow fluidic logic device having a first laminar proportional fluid amplifier which has a supply stream input port connected to a fluid pressure supply, a first control stream input port, a second control stream input port, a first output port and a second output port. The device further includes a fluid pressure feedback means having an input connected to the first output port and an output connected to the second control stream input port, for supplying a feedback pressure having a magnitude sufficient to saturate the amplifier so that the supply stream from the supply stream input port is directed through the first output port. The first control stream input port is connected to a fluid pressure signal source for receiving a fluid pressure signal having a magnitude sufficient to saturate the amplifier so that the supply stream from the supply stream input port is directed through the second output port. The fluidic logic device further comprises a second laminar proportional fluid amplifier having a supply input port connected to the fluid pressure supply, a first control stream input port connected to the first output port of the first amplifier, a second control stream input port connected to the second output port of the first amplifier, and an output port connected to a utilization device. The second amplifier serves to decouple the operation of the first amplifier from the utilization device.

DISCUSSION OF THE PREFERRED EMBODIMENT

Figure 1:
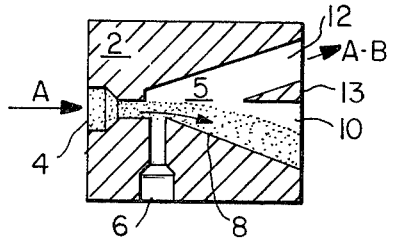
FIG. 1 is an illustration of a prior art fluidic AND gate.
Figure 2A:
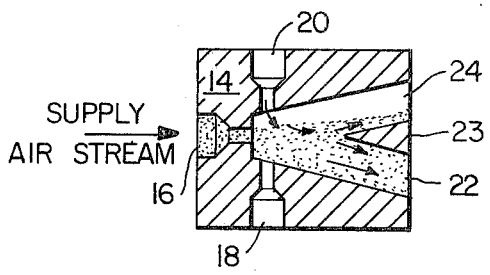
FIG. 2*a* is an illustration of a laminar proportional amplifier with the control input below the saturation level.
Figure 2B:
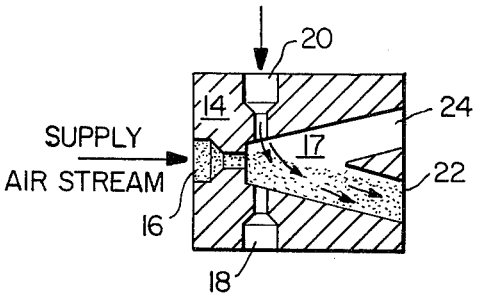
FIG. 2*b* is an illustration of a laminar proportional amplifier with the control input above the saturation level.

The laminar flow digital logic elements with feedback invention employs a laminar proportional amplifier, such as is shown in FIGS. 2*a* and 2*b*. A high energy stream of fluid, called the supply air stream, is input at the input port 16. The stream passes across the widened chamber 17, designed to prevent the stream from clinging to either of the channel walls, and arrives at a fork consisting of the two outgoing channels 22 and 24 separated by a pointed structure called the splitter 23. If the power stream has not been disturbed and hits the splitter 23 headon, the stream will be divided in two, half of the fluid passing into one outlet channel 22 and half into the other 24. As the power stream enters the system, it runs past two control jets 18 and 20, one on each side of the amplifier 14. In FIG. 2*a*, when one of the jets 20 is turned on and the control stream hits the supply stream with a certain pressure, it will deflect the supply stream by a certain amount. The output in channel 22 represents an amplification of the energy applied by the control jet 20, and the gain is equal to the ratio between the differential output pressure and the differential control pressure. Since the degree of the deflection of the supply air stream is proportional to the pressure difference across the supply jet, the system is called a proportional amplifier. Since the flow of the supply air stream through the chamber 17 is not turbulent but is instead, laminar, the device 14 is called a laminar proportional amplifier. The prior art has conventionally used the laminar proportional amplifier 14, shown in FIG. 2*a* as an analog device, serving to amplify signals through a continuum pressures between two bounded pressure values.

In the laminar flow digital logic elements with feedback invention disclosed herein, the laminar proportional amplifier is operated in the saturation mode, where the pressure of the fluid introduced at the input control ports 18 or 20, is sufficiently high to force the supply stream flowing through the chamber 17 to flow exclusively in either channel 22 or channel 24. This saturation mode of operation, when combined with the disclosed feedback connections for the device, provide a fluidic element capable of carrying out binary logical functions, where the supply air stream remains in a laminar flow state. The use of laminar flow, instead of the turbulent flow associated with wall-attachment devices, permits the performance of digital logic functions with a relatively low power consumption, a high signal to noise ratio and a repeatable signal threshold.

Figure 3:
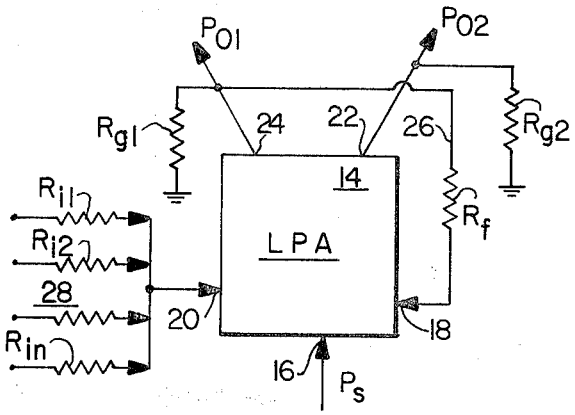
FIG. 3 is a symbolic illustration of an AND/OR fluidic logic circuit.

The laminar flow digital AND/OR function is described first. FIG. 3 shows the schematic of an AND-/OR unit which operates as follows. Due to the feedback 26 through Rf, the output Po1 is on at output 24. When a sufficient input signal, Pi, is applied at 28 to the input fluid resistors Ri, the output fluid flow is switched from Po1 at output 24 to Po2 at output 22. Upon removal of the input signal at fluid resistors 28, the output will switch from Po2 to Po1 at output 24. The threshold level of the input signal at control port 20 is dependent on the gain of the laminar proportional amplifier gain block 14, and the ratio of the sum of the fluid resistances Ri over the fluid resistance Rf. The hysteresis of the circuit can be controlled by adjusting both fluid resistors Rg1 at output 24 and Rg2 at output 22. The element of FIG. 3 can be made to operate either as an AND or OR element by adjusting the input resistors Ri1, Ri2, thru Ri*n*. The OR function obtains when each fluid resistor Ri at 28 permits a sufficient magnitude fluid pressure to be introduced into control port 20, to saturate the amplifier 14. The AND function obtains when each of the *n* fluid resistors Ri at 28 permits a magnitude of fluid pressure of $1/n$ of that pressure sufficient to saturate the amplifier 14, to be introduced into control port 20.

The NOT function employing a laminar proportional amplifier, is disclosed next. The circuit of FIG. 3 can be modified by using only one of the Ri fluid resistors to make the NOT unit. Its principle of operation is similar to that of the AND/OR unit. In this NOT unit, Po1 at output 24 is considered to be the ON state Upon introducing a sufficient input signal at a single fluid resistor 28, the ON output state will change to Po2 at output 22. The output fluid flow will stay on Po2 at output 22 as long as Pi at fluid resistor 28 is on.

The Schmidt trigger function, employing a laminar proportional amplifier, is disclosed next. FIG. 3 can be operated as the Schmidt trigger using only one of the Ri fluid resistors 28. Initially, Po2 at output 22 is zero because the supply jet 16 is deflected to the left output 24 by the feedback signal on feedback 26. When a sufficient signal is applied to fluid resistor Ri at 28, the output state at output 22 will change to one. The signal threshold is dependent on the ratio of fluid resistances Ri/Rf and the gain of the LPA gain block 14.

Figure 4:
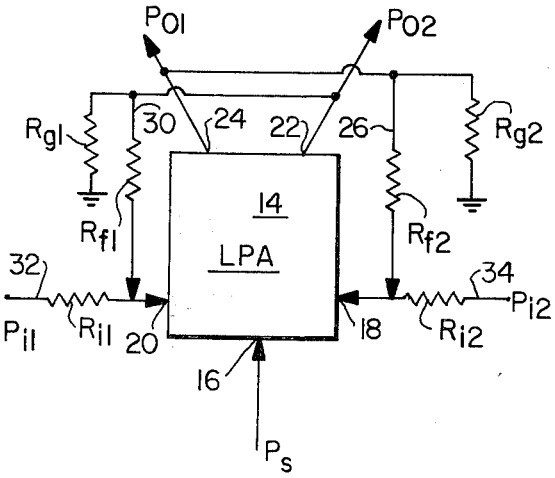
FIG. 4 is a symbolic illustration of a fluidic logic flip-flop.

The flip-flop function employing a laminar proportional amplifier, is disclosed next. The schematic of the flip-flop is shown in FIG. 4. Its operational principles are as follows. Assume that the unit is initially having its output Po1 on at 24. The output signal will be present at Po1 at output 24 until a sufficient signal is applied to fluid resistor Ri1 at 32. When a signal which is sufficiently large enough to overcome the feedback signal 26 coming from fluid resistor Rf2, the output signal will switch from Po1 at output 24 into Po2 at output 22. Even upon removal of the input signal, Pi1 at fluid resistor 32, the output signal will remain at Po2 at output 22 because of the feedback flow coming from fluid resistor Rf1 at 30. The signal level which is required to switch the output states is dependent on the gain of the LPA gain block 14, the Ri/Rf resistance ratio and the value of the fluid resistors Rg1 and Rg2. The hysteresis of the circuit can be controlled by adjusting the value of Rg1 and Rg2.

Figure 5:
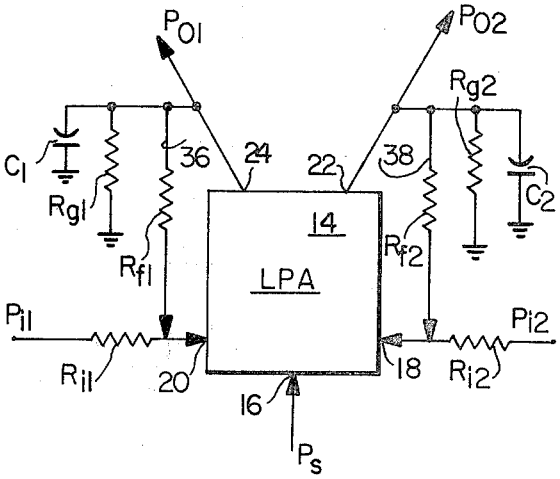
FIG. 5 is a symbolic illustration of a fluidic feedback oscillator/frequency modulator.

The feedback oscillator/frequency carrier function employing a laminar proportional amplifier, is disclosed next. FIG. 5 shows the schematic of the feedback oscillator/frequency carrier. The LPA 14 of FIG. 2*b* has its supply port 16 connected to a fluid pressure supply, its control port 18 connected by a feedback line 38 from the output port 22, and its control port 20 connected by a feedback line 36 from its output port 24. Its principles of operation are as follows. Assuming that the output signal at output 24 is initially at Po1, a portion of this output signal at 24 is fed back to the left control port 20 thru the feedback resistor, Rf1 of feedback 36, and causes the output signal to switch to Po2 at output 22. While output signal is on Po2 at output 22, a feedback signal coming from fluid resistor Rf2 over feedback 38, is applied to the right control port 18 of the LPA block 14 and causes the output signal to change position again to output 24. This process will continue as long as the supply stream pressure at 16 is maintained. The characteristic frequency of oscillation is dependent on the supply stream pressure, the gain of the amplifier block 14, the values of fluid capacitances C1 and C2 and fluid resistances Rg1, Rg2, Rf, and Rf2. When a signal having a signal frequency is applied to either control input 18 or 20, this signal frequency will modulate the oscillator's characeristic frequency and then the oscillator functions as a frequency modulator with the oscillator's characteristic frequency being the carrier frequency.

All the laminar flow digital logic elements and the oscillator discussed above require a high gain LPA to insure a fast switching rise time to perform their functions properly. It has been found that the minimum gain required for the LPA is about 6. It should be noted that the resistors, Rg control switching hysteresis for the circuit.

Figure 7:
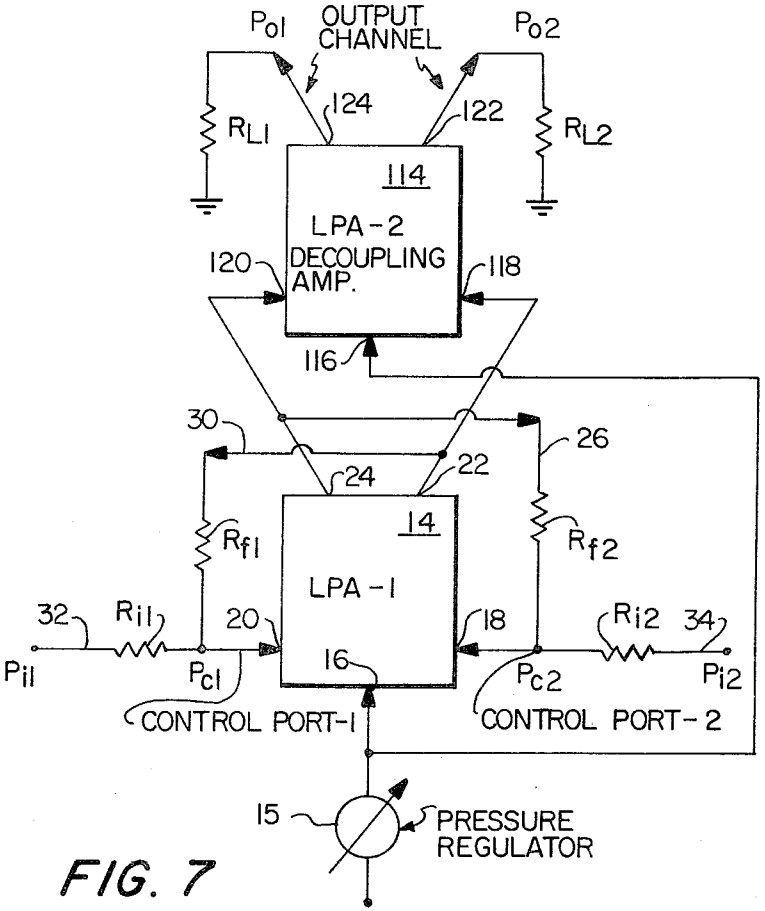
FIG. 7 is a symbolic illustration of an alternate embodiment of the flip-flop fluidic logic element.
Figure 6:
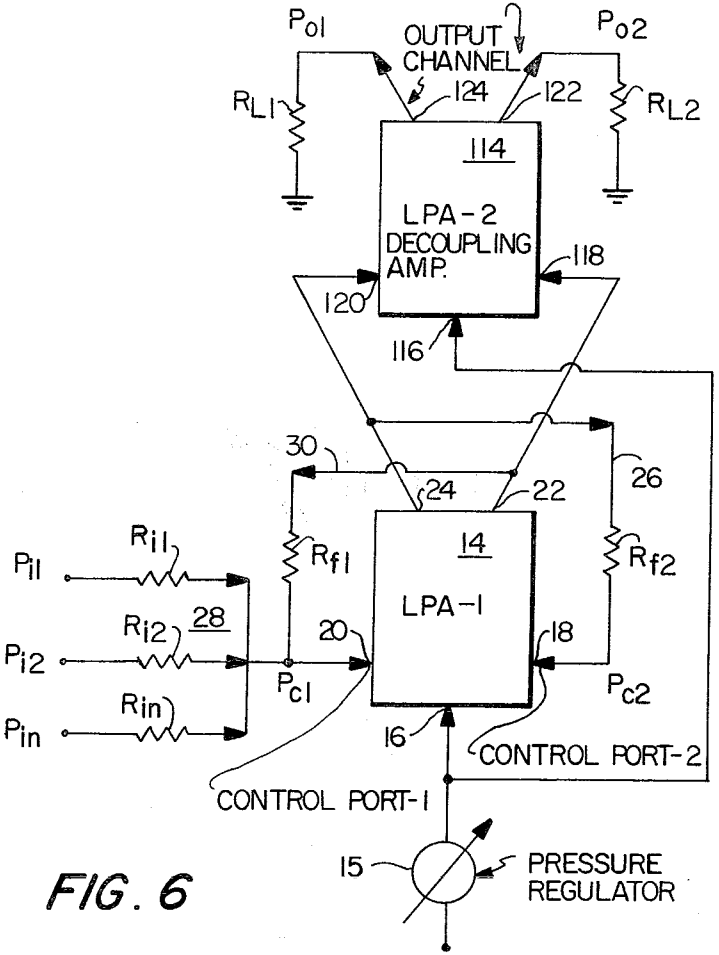
FIG. 6 is a symbolic illustration of an alternate embodiment of the AND/OR fluidic logic circuit.

If the circuit utilizing the output of LPA 14, generates large pressure perturbations which can couple with the feedback line 26, spurious switching can occur in LPA 14. Therefor in noise prone applications, it is essential to decouple the output of LPA 14 from the utilization circuit. FIGS. 6 and 7 show AND/OR and flip-flop circuits as described in FIGS. 3 and 4 respectively, with a second laminar proportional amplifier 114, connected to the outputs 22 and 24 of LPA 14, to decouple the circuit 14 from any perturbations originating from a utilization device driven by the outputs of the second amplifier 114.

The AND/OR unit with a decoupling amplifier, is disclosed next. FIG. 6 shows the schematic of the AND/OR unit with the decoupling LPA 114. It consists of two LPA's 14 and 114, as shown in FIG. 2*b*, two feedback paths 26 and 30 having fluid resistors, Rf1 and Rf2 respectively, and *n*-input fluid resistors, Ri*n* at 28. Feedback path 26 connects output port 24 of LPA 14 to its control port 18. Feedback path 30 connects output port 22 of LPA 14 to its control port 20. Parallel input fluid resistors Ri1 to Ri*n* are connected to control port 20. Output ports 22 and 24 of LPA 14 are input to control ports 118 and 120 of LPA 114, respectively. The circuits operational principles are as follows. When the supply pressure at 15 is on, the output signal Po2 is on at output channel 122. This occurs because the feedback signal coming through fluid resistor Rf2 over line 26 drives the supply stream from port 18 to saturation into output channel 24 of LPA 14. This, in turn, pressurizes control port 120 of LPA 114, driving the supply stream from port 116 to saturation in output channel 122 of LPA 114, to affect an output signal at output channel 122. The utilization device can be represented by the fluid resistor loads RL1 and RL2. Pressure perturbations arising in the utilization device are prevented from disturbing the operation of LPA 14 by means of the decoupling effect of LPA 114. When the circuit of FIG. 6 operates as an OR unit, it requires only one of the input signals at fluid resistors 28 to switch the output state. When the circuit of FIG. 6 operates as an AND unit, it needs the sum of all the input signals at fluid resistors 28 to change the output states. The unit can be made to function as an AND or an OR element by adjusting the values of the resistors Ri*n*, Rf1, and Rf2 and the gain of LPA 14. It should be pointed out that when one of the control pressures at 18 or 20 becomes sufficiently large to overcome the control pressure at the other control channel, the output state will switch because of the regenerative nature of the feedback signal.

The flip-flop with a decoupling amplifier, is disclosed next. Besides the AND/OR element, the flip-flop is another essential digital logic element. Feedback path 26 connects output port 24 of LPA to its control port 18. Feedback path 30 connects output port 22 of LPA 14 to its control port 20. Input fluid resistors Ri1 and Ri2 are connected to the control ports 20 and 18, respectively. Output ports 22 and 24 of LPA 14 are input to the control ports 118 and 120 of the LPA 114. The structure of LPA 14 and LPA 114 is shown in FIG. 2*b*. The following is a brief description of the principles of operation of the flip-flop. When the supply 15 is turned on, the on-state of the flip-flop will either be at output channel 124 or output channel 122 because of the regenerative nature of the feedback signal. Assume that the on-state is initially at output channel 124. (Po1 = 1, Po2 = 0). The on-state will remain at output channel 124 until a sufficiently large control pressure, Pc2, at control port 18 overcomes the control pressure, Pc1, at control port 20. The control pressure, Pc2, consists of the feedback signal coming through the feedback fluid resistor, Rf2 in line 26, and the input signal passing through the input fluid resistor, Ri2 at 34. As an input signal Pi2 is initiated at 34, to affect a control pressure at control port 18, the control pressure, Pc2, begins to increase solely due to the applied input pressure because output 24 of LPA 14 is still at the off-state. As we continue to increase the input pressure, Pi2, the supply stream from port 16 begins to deflect toward output channel 24. As the supply stream deflects toward output channel 24, a feedback signal begins to flow over line 26 through fluid resistor Rf2 and causes Pc2 at control port 18 to increase and at the same time the control pressure, Pc1 at control port 20, begins to decrease due to the decreasing flow over line 30 through fluid resistor Rf1. As a result, the differential control pressure, Pc1-Pc2, across the supply stream from port 16 increases rapidly and causes the supply stream to "switch" from output channel 22 into output channel 24. The output line 24 of LPA 14 is now pressurized, inputing a signal at control port 120 of LPA 114, and causing LPA 114 to switch from output 124 to output 122. Thus the switching is completed. The on-state will remain at output channel 122 of LPA 114 even upon the removal of the input pressure, Pi2 from control port 18, because the feedback signal coming through fluid resistor Rf2 over line 26 is large enough to deflect the supply stream from port 16 almost entirely into output channel 24 of LPA 14. The switching of the state from output channel 122 to output channel 124 of LPA 114 can be accomplished in a similar manner. LPA 114 serves to decouple the LPA 14 from perturbations arising in a utilization device, represented as the fluid resistor loads RL1 and RL2.

Laboratory observations indicate that LPA 14 and LPA 114 will function satisfactorily in the circuits disclosed over an operating range of a Reynolds number N4=400 to 1200. The decoupled embodiment of the invention shown in FIGS. 6 and 7 is not limited to the AND/OR and flip-flop elements but can be modified to perform functions such as a Schmidt trigger, NAND, NOT, etc., as was discussed previously for FIGS. 3, 4 and 5.

While I have described and illustrated several specific embodiments of my invention, it will be clear that variations of the details of construction which are specifically illustrated and described may be resorted to without departing from the true spirit and scope of the invention as defined in the appended claims.

I claim:

1. A laminar flow fluidic logic device, comprising:

a first laminar proportional fluid amplifier having a supply stream input port connected to a fluid pressure supply, a first control stream input port, a second control stream input port, a first output port and a second output port;

a first fluid pressure feedback means having an input connected to said first output port and an output connected to said second control stream input port, for supplying a feedback pressure having a magnitude sufficient to saturate said amplifier so that the supply stream from said supply stream input port is directed through said first output port;

said first control stream input port connected to a first fluid pressure signal source for receiving a first fluid pressure signal having a magnitude sufficient to saturate said amplifier so that the supply stream from said supply stream input port is directed through said second output port;

whereby a fluid digital logic function may be performed in an improved manner.

2. The laminar flow fluidic logic device of claim 1, which further comprises:

a second laminar proportional fluid amplifier having a supply input port connected to said fluid pressure supply, a first control stream input port connected to said first output port of said first amplifier, a second control stream input port connected to said second output port of said first amplifier, and an output port connected to a utilization device;

whereby the operation of said first amplifier is decoupled from said utilization device.

3. The laminar flow fluidic logic device of claim 2, which further comprises:

said first fluid pressure signal source comprising a plurality of input pressure signal means, each having a sufficient magnitude fluid pressure to saturate said first amplifier;

whereby a logical OR function is formed in an improved manner.

4. The laminar flow fluidic logic device of claim 2, which further comprises:

said first fluid pressure signal source comprising a plurality of $n$ input pressure signal means, each having a magnitude of fluid pressure of approximately $1/n$ of that sufficient to saturate said first amplifier;

whereby a logical AND function is formed in an improved manner.

5. The laminar flow fluidic logic device of claim 2, wherein said first fluid pressure signal has a sufficient magnitude to saturate said first amplifier, said first amplifier operates as a Schmidt trigger.

6. The laminar flow fluidic logic device of claim 2, which further comprises:

a second fluid pressure feedback means having an input connected to said second output port of said first amplifier and an output connected to said first control stream input port of said first amplifier, for supplying a feedback pressure having a magnitude sufficient to saturate said first amplifier so that the supply stream from said supply stream input port in said first amplifier, is directed through said second output port of said first amplifier;

said second control stream input port of said first amplifier connected to a second fluid pressure signal source for receiving a second fluid pressure signal having a magnitude sufficient to saturate said first amplifier so that the supply stream from said supply stream input port of said first amplifier is directed through said first output port of said first amplifier;

whereby a logical flip-flop device is formed in an improved manner.

7. The laminar flow fluidic logic device of claim 1, which further comprises:

said first fluid pressure signal source comprising a plurality of input pressure signal means, each having a sufficient magnitude fluid pressure to saturate said first amplifier;

whereby a logical OR function is formed in an improved manner.

8. The laminar flow fluidic logic device of claim 1, which further comprises:

said first fluid pressure signal source comprising a plurality of $n$ input pressure signal means, each having a magnitude of fluid pressure of approximately $1/n$ of that sufficient to saturate said first amplifier;

whereby a logical AND function is formed in an improved manner.

9. The laminar flow fluidic logic device of claim 1, wherein when said first fluid pressure signal has a sufficient magnitude to saturate said first amplifier, said first amplifier operates as a Schmidt trigger.

10. The laminar flow fluidic logic device of claim 1, which further comprises:

a second fluid pressure feedback means having an input connected to said second output port of said first amplifier and an output connected to said first control stream input port of said first amplifier, for supplying a feedback pressure having a magnitude sufficient to saturate said first amplifier so that the supply stream from said supply stream input port in said first amplifier, is directed through said second output port of said first amplifier;

said second control stream input port of said first amplifier connected to a second fluid pressure signal source for receiving a second fluid pressure signal having a magnitude sufficient to saturate said first amplifier so that the supply stream from said supply stream input port of said first amplifier is directed through said first output port of said first amplifier;

whereby a logical flip-flop device is formed in an improved manner.

11. A laminar flow fluidic device, comprising:

a first laminar proportional fluid amplifier having a supply stream input connected to a fluid pressure supply, a first control stream input port, a second control stream input port, a first output port and a second output port;

a first fluid pressure feedback means having an input connected to said first output port and an output connected to said first control stream input port, for supplying a feedback pressure having a magnitude sufficient to saturate said amplifier so that the supply stream from said supply stream input port is directed through said second output port;

a second fluid pressure feedback means having an input connected to said second output port and an output connected to said second control stream input port, for supplying a feedback pressure having a magnitude sufficient to saturate said amplifier so that the supply stream from said supply stream input port is directed through said first output port;

whereby each of said ouput ports outputs a fluid pressure which oscillates at a characteristic frequency.

12. The laminar flow fluidic device of claim 11, which further comprises:

a second laminar flow proportional fluid amplifier having a supply input port connected to said fluid pressure supply, a first control stream input port connected to said first output port of said first amplifier, a second control stream input port connected to said second output port of said first amplifier, and an output port connected to a utilization device;

whereby the operation of said first amplifier is decoupled from said utilization device.

13. The laminar flow fluidic device of claim 12, which further comprises:

said first control stream input port of said first amplifier connected to a fluid pressure signal source for receiving a fluid pressure signal having a signal frequency;

whereby the characteristic frequency of said output fluid pressure of said first amplifier is modulated by said signal frequency.

14. The laminar flow fluidic device of claim 11, which further comprises:

said first control stream input port of said first amplifier connected to a fluid pressure signal source for receiving a fluid pressure signal having a signal frequency;

whereby the characteristic frequency of said output fluid pressure of said first amplifier is modulated by said signal frequency.

* * * * *